US005823492A

United States Patent [19]

Anselmo

[11] Patent Number: 5,823,492

[45] Date of Patent: Oct. 20, 1998

[54] CARPET PROTECTOR

[76] Inventor: Anthony Gray Anselmo, 177 Main St., Harwich, Mass. 02645

[21] Appl. No.: 755,629

[22] Filed: Nov. 25, 1996

Related U.S. Application Data

[63] Continuation of Ser. No. 496,056, Jun. 28, 1995, abandoned.

[51] Int. Cl.[6] ..... F16M 11/20

[52] U.S. Cl. ..... 618/188.1; 248/346.11

[58] Field of Search ..... 248/346.11, 188.1, 248/188.9

[56] References Cited

U.S. PATENT DOCUMENTS

| | | | |
|---|---|---|---|
| 342,970 | 6/1886 | Ougley | 248/346.11 |
| 1,559,827 | 3/1924 | Wittman | 248/346.11 |
| 3,333,805 | 8/1967 | Marshall | 248/188.9 |
| 4,659,049 | 4/1987 | Watson | 248/346.11 |

FOREIGN PATENT DOCUMENTS

| | | | |
|---|---|---|---|
| 2214422 | 9/1989 | United Kingdom | 248/188.1 |

*Primary Examiner*—Leslie A. Braun
*Assistant Examiner*—Willie Berry, Jr.
*Attorney, Agent, or Firm*—Steven N. Fox, Esq.

[57] ABSTRACT

A device which protects a carpet from furniture by providing a pedestal type device on which the furniture rests. The device is comprised of a generally flat, horizontal element with a plurality of vertical, downwardly projecting, stiff pins attached thereto. The pins protrude though the carpet pile, through grid openings in the carpet backing, through the carpet pad and onto the floor surface. The furniture rests on the horizontal element which is held above the carpet by the pins. The furniture does not touch the carpet itself.

1 Claim, 2 Drawing Sheets

CARPET PROTECTOR

This is a continuation of application Ser. No. 08/496,056 filed on Jun. 28, 1995, now abandoned.

BACKGROUND OF THE INVENTION

This invention relates to carpet protectors, and in particular to a device for protecting carpets from articles of furniture which normally lie in direct contact with a carpet.

Carpets are comprised of a relatively stiff, grid-shaped, backing material through which a softer pile material, i.e., strands of fabric with a surface of upright yarns, is tufted or woven. A secondary backing may be glued to the main backing to hold the tufts in place. When laying a carpet on a floor, a resilient pad is first placed on the floor over the floor area on which the carpet is to be laid. The carpet then is positioned over and laid on the resilient pad. The carpet is horizontally positioned on the pad so that the backing rests against the pad and the carpet piles protrude vertically upward from the backing. When furniture rests on a laid carpet for a period of time, it crushes the pile, the backing and the pad, forming indentations thereon. When the pile gets crushed, it generally can be brushed out to nearly its original form. However, when the backing gets bent, it will not return to its original form. Also, once a pad gets crushed over a period of time, i.e., generally a month or more, it will not come back to its original form. The bent backing and crushed pad will be visible through the carpet pile as indentations or marks marring the pile. Therefore, once furniture is placed on a laid carpet, the furniture cannot be rearranged without leaving indentation and ugly marks visible on the carpet. The only recourse is to either position other furniture over the residual indentation marks or replace the original carpet and pad. Prior art furniture caps attempt to protect carpet pile by distributing the loading caused by a particular piece of furniture over a larger area. However, prior art furniture caps merely make larger residual marks in the backing and pad.

SUMMARY OF THE INVENTION

The present invention protects a carpet from furniture by providing a pedestal type device on which the furniture rests. The device is comprised of a generally flat, horizontal element with a plurality of vertical, downwardly projecting, stiff pins attached thereto. The pins protrude though the pile, through grid openings in the backing, through the pad and onto the floor surface. The furniture rests on the horizontal element which is held above the carpet by the pins. The furniture does not touch the carpet itself. The device does not damage the carpet. Any damage to the pad is slight and not visible through the carpet piling. When rearranging furniture, the devices are simply repositioned to a desired location and the furniture positioned thereon. Any carpet marks from the original furniture position will be invisible.

These together with other objects of the invention, along with various features of novelty which characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

DETAILED DESCRIPTION OF THE INVENTION

Figure 2:
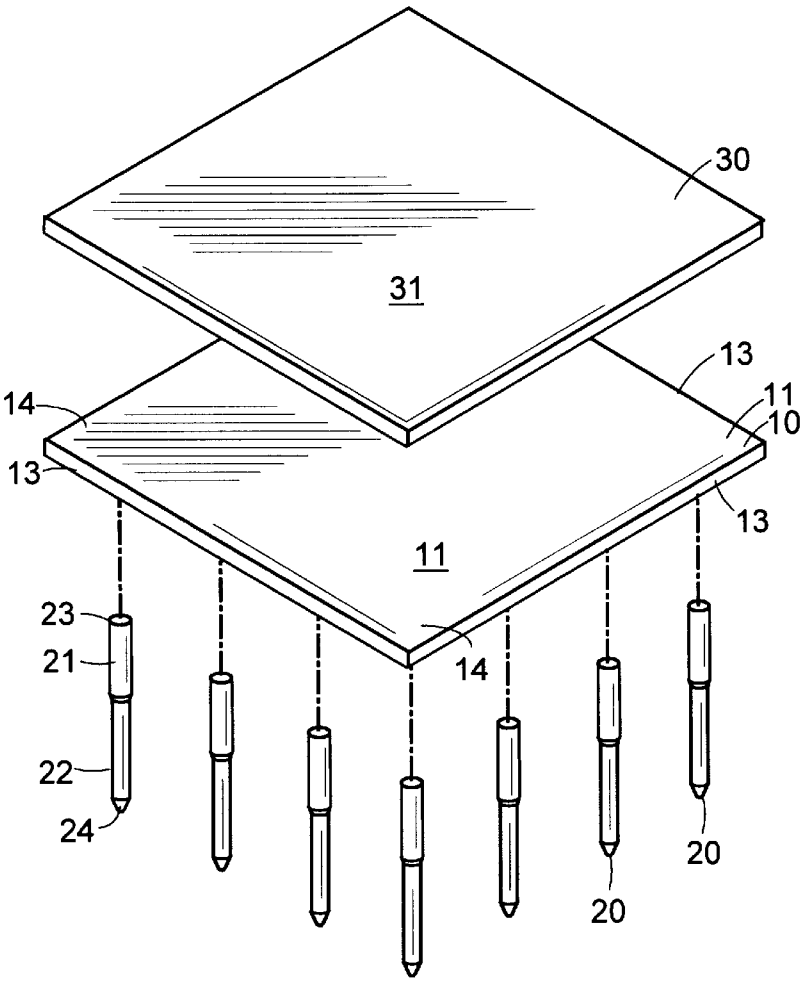
FIG. 2 is an exploded view of FIG. 1.
Figure 1:
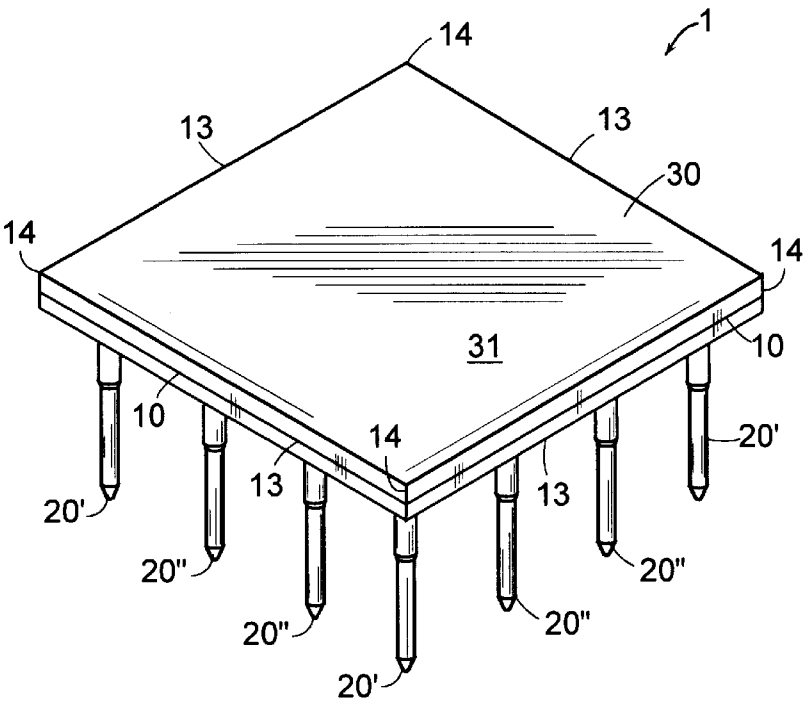
FIG. 1 is a perspective view of one embodiment of the invention.

Referring to the drawings in detail wherein like elements are indicated by like numerals, there is shown an embodiment of the invention 1 incorporating a device for protecting carpets from furniture loading. The invention 1 is comprised of a generally horizontal element 10 having a top surface 11, an under surface 12, and four sides 13, said under surface 12 having a plurality of vertical, downwardly projecting, stiff pins 20 attached thereto, and said top surface 11 having a pad 30 attached thereto. The horizontal element 10 may be made of metal, wood, plastic or other material, including laminates, having strength and stiffness. In this embodiment of the invention 1, the horizontal element 10 is formed in the shape of a square with each side 13 having a longitudinal dimension of 2¼ inches, and would be considered a medium sized carpet protector. In other embodiments of the invention 1, the sides 13 may be shorter or longer. The horizontal element 10 may also have a circular, rectangular or polygonal shape.

In this embodiment of the invention 1, each pin 20 is 1 inch long. In other embodiments the pins 20 could be as short as ¼ inch for commercial carpets and as long as 1¼ inch for certain residential applications. Each pin 20 is divided into two portions, a top portion 21 and a bottom portion 22. In this embodiment of the invention the top 21 and bottom 22 portions are both cylindrical, with the top portion 21 having a diameter approximately double that of the bottom portion 22. In this embodiment of the invention, the top portion 21 has a vertical length of ⅜ inch. The bottom portion 22 has a vertical length of ⅝ inch. The bottom portion 22 diameter must be as thin as possible without weakening the pin so that it can not withstand a reasonable furniture load. A reasonable compromise would be a thickness equal to that of a number "16" nail. The pin upper top portion 21 will have a diameter of approximately ⅛ inch. The pin bottom portion 22 will have a diameter of approximately 1/16 inch. The top 23 of each pin 20 is attached to the horizontal element undersurface 12. This attachment may be done by any number of means, glue, welding, threaded, etc. The pins 20 may also be partially punched out and formed from the horizontal element 10. In this embodiment, a pin 20' is attached near to the four junctions 14 formed by the four sides 13. Two additional pins 20" are attached to the horizontal element undersurface 12 between each pair of junction pins 20'. For smaller carpet protectors 1, only one pin 20" would be attached to the horizontal element undersurface 12 between each pair of junction pins 20'. For larger carpet protectors 1, three pins 20" would be attached to the horizontal element undersurface 12 between each pair of junction pins 20'. Each pin bottom 24 must have a sharp enough point to slide through a carpet backing grid, but not be so sharp as to dig into a floor. The pins 20 would be preferably rust proof to withstand carpet cleaning and washing without rusting. A material such as stainless steel, galvanized steel or coated steel would appear to be the preferred material of choice. Each size of the invention, i.e., small, medium and large, would accommodate different size furniture legs and weights of furniture. A set of four small size protectors 1 would hold up to a 250 pound furniture piece. A set of four medium size protectors 1 would hold up to a 500 pound furniture piece. A set of four large size protectors 1 would hold up to a 800 pound furniture piece.

The pad 30 has a top surface 31 and a bottom surface 32, said bottom surface 32 being glued to the horizontal element top surface 11. The pad 30 would have the same side dimensions as the horizontal element. The pad 30 would be made from a resilient, slide-proof material such as felt or rubber. Although the pad 30 is not an absolute requirement for the invention's proper function, it is a preferred addition.

Figure 4:
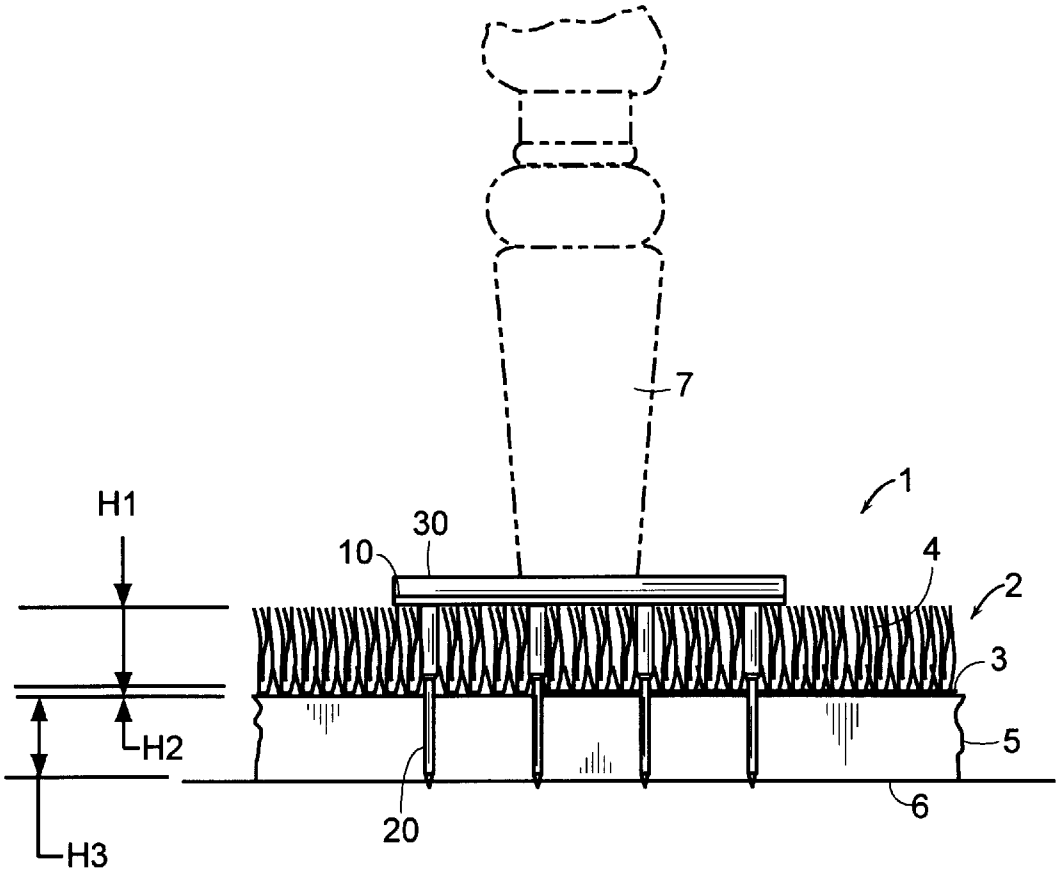
FIG. 4 is a side view of the invention positioned over a carpet on a floor.
Figure 3:
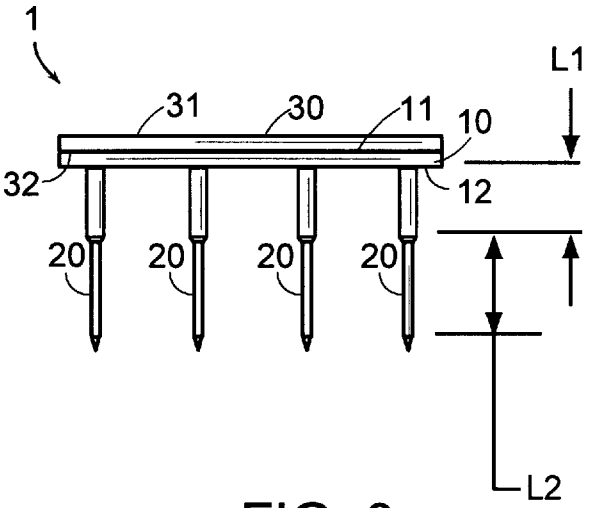
FIG. 3 is a side elevational view of the embodiment shown in FIG. 1.

The invention's operation may be best understood from FIG. 4. A carpet 2 comprised of a sheet of grid-like backing material 3 with pile material 4 looped or threaded through the backing 3 is laid on a carpet pad 5 which had been positioned over a floor 6. The carpet pad 5 typically has a vertical thickness of ½ inch. The carpet backing 3 will typically have a vertical thickness of 1/32 inch. The carpet pile 4 will typically have an average thickness of ½ inch. The instant invention carpet protector 1 is placed on and through the carpet 2 and carpet pad 5 to the floor 6. The horizontal element 10 has a top surface to bottom surface thickness of 1/16 inch. The pad 30 attached to the top surface has a vertical thickness of ⅛ inch. The pins 20 protruding from the horizontal element under surface have a length of 1 inch. The furniture support piece 7 rests on the pad's top surface 31. The carpet protector horizontal element 10 barely touches the pile 4. The furniture element 7 does not touch the carpet 2. The carpet protector pins 20 slide through the carpet backing 3 grid.

It is understood that the above-described embodiment is merely illustrative of the application. Other embodiments may be readily devised by those skilled in the art which will embody the principles of the invention and fall within the spirit and scope thereof.

I claim:

1. A carpet protector system in combination with a floor and a piece of furniture, the system comprising:

(a) a pad disposed upon the floor, said pad having H3:

(b) a carpet disposed upon said pad, said carpet comprising a pile material disposed upon a sheet of grid-like backing material, and pile material having a height H1 and said backing material having a height H2; and (c) a carpet pad protector disposed upon said pile material, said carpet protector comprising a substantially horizontal member having an upper surface and a lower surface, said carpet pad protector further comprising a plurality of pin members extending downwardly from said lower surface, said pin members having a top portion and a bottom portion, said top portion having a length L1 shorter than said height H1 of said pile material, said bottom portion having a length L2 terminating in an end point, said length L2 being at least as long as the combined height of said H2 of said backing material and said height H3 of said pad, said top portion having a substantially uniform cross-section area along said length L1, said bottom portion having a cross-section along said L2 less than said uniform cross-section of said upper portion;

(d) said bottom portion of said pin members passing through said backing material and said pad without substantially crushing and damaging said backing material, said uniform cross-section of said top portion of said pin member through said pile material and are dimensionally restrained from coming in substantial contact with said backing material; and (e) when a force is applied to said carpet pad protector by the weight of the piece of furniture, substantially all of said force is transmitted through said pin members and directly to said floor thereby preventing any substantial crushing and damage to said backing material and whereby points of said elongated members are in direct contact with said floor without penetrating said floor.

* * * * *